US005816943A

United States Patent [19]

Masutani et al.

[11] Patent Number: 5,816,943

[45] Date of Patent: Oct. 6, 1998

[54] GOLF BALLS AND THEIR PRODUCTION PROCESS

[75] Inventors: Yutaka Masutani; Keisuke Ihara; Hirotaka Shimosaka, all of Saitama, Japan

[73] Assignee: Bridgestone Sports Co., Ltd., Tokyo, Japan

[21] Appl. No.: 854,091

[22] Filed: May 9, 1997

[30] Foreign Application Priority Data

May 13, 1996 [JP] Japan ..... 8-142233

[51] Int. Cl.[6] ..... A63B 37/12; A63B 37/14

[52] U.S. Cl. ..... 473/365; 473/377; 473/383; 29/899

[58] Field of Search ..... 473/365, 377, 473/383, 409; 29/899

[56] References Cited

U.S. PATENT DOCUMENTS 5,225,133 7/1993 Ihara et al. ..... 473/383 X 5,695,414 12/1997 Yokota ..... 473/378 X 5,704,853 1/1998 Maruko et al. ..... 473/363

*Primary Examiner*—George J. Marlo

*Attorney, Agent, or Firm*—Sughrue, Mion, Zinn, Macpeak & Seas, PLLC

[57] ABSTRACT

A golf ball includes a cover and a coating formed on the cover, and dimples are formed in a layer composed of the cover and the coating. The coating is formed of a material having contraction and expansion properties and a higher heat resistance than the material for the cover and has a thickness of at least 15 $\mu$m. In a process for producing the golf ball, after the formation of the coating, dimples are formed through the coating by conducting compression molding at a molding temperature near the melting point of the cover. In the golf ball, dimples can be precisely shaped and sharp edged through precise reproduction of design values of dimples. Moreover, the golf ball does not require deburring after dimple formation, thereby preventing a reduced preciseness of dimple shape and resultant variations in quality.

14 Claims, 3 Drawing Sheets

GOLF BALLS AND THEIR PRODUCTION PROCESS

BACKGROUND OF THE INVENTION

1. Field of the Invention

The present invention relates to a golf ball whose dimples can be formed with their design values precisely reproduced to thereby prevent variations in golf ball quality. It also relates to a production process thereof.

2. Related Art

Multipiece golf balls, such as two-piece golf balls and three-piece golf balls, and thread-wound golf balls are usually produced by a process which comprises enclosing a solid core or a thread-wound core with a cover material, forming dimples by compression or injection molding, applying a coating on the surface of the cover material, conducting mark stamping by a transfer printing method, and then forming an outermost layer coating of the ball. In some cases, the mark stamp may be directly applied to the cover material surface, and then an outermost layer coating may be formed.

In this case, the coating on the surface of the cover material and the outermost layer coating of the ball mainly use a two-pack system coating material. Since a coating formed of this coating material cannot be easily deformed by application of heat and pressure, dimples cannot be easily formed after formation of such a coating. Therefore, coating is performed after dimples are formed as described above.

However, golf balls produced by a process in which formation of dimples precedes coating and mark stamping have had the following problems:

① Since a coating is formed on dimples, the coating shallows the dimples and dulls dimple edges if formed relatively thick, thus reducing preciseness of dimple shape. Accordingly, a coating is made as thin as possible in order to reduce this undesirable effect, though it still remains difficult to obtain precisely shaped and sharp edged dimples through precise reproduction of design values of dimples.

② When mark stamping is conducted by a transfer printing method after dimples are formed, a dimpled cover is subjected to heat and pressure. Accordingly, in some cases, dimples are damaged and deformed, resulting in less precise dimple shapes.

③ In a process of enclosing a solid core or a thread-wound core with a cover material and forming dimples in the cover material by compression or injection molding, a molten cover material flows into a gap between molds and then solidifies, with a result that burrs are formed. Therefore, after a cover is formed, burrs are removed, followed by coating or mark stamping on the cover. However, since the ball surface is partially scraped during deburring, the precision of the dimple shapes of this scraped portion is considerably impaired, resulting in some cases in variations in golf ball quality.

SUMMARY OF THE INVENTION

The present invention was made in view of the above problems, and has the object of providing a golf ball whose dimples can be precisely shaped and sharp edged through precise reproduction of design values of dimples and which does not require deburring after dimple formation, thereby preventing a reduced preciseness of dimple shape and resultant variations in golf ball quality. The invention also has an object of providing a process of producing such golf balls.

To achieve the above object, the present invention provides a golf ball which comprises a cover and a coating formed on the cover and in which dimples are formed in a layer composed of the cover and the coating, wherein the coating is formed of a material having contraction and expansion properties and a higher heat resistance than the material for the cover and has a thickness of at least 15 μm. Preferably, the golf ball of the present invention comprises a main body and one or more coating layers formed on the main body, at least one of the coating layers is formed of a material having contraction and expansion properties and a higher heat resistance than the material for the cover and has a thickness of at least 15 μm.

The present invention also provides a golf ball production process comprising the steps of forming a coating on the surface of a main body having a cover on which dimples have not been formed. The coating is formed of a material having contraction and expansion properties and a higher heat resistance than the material for the cover and has a thickness of at least 15 μm. Compression molding for forming dimples is then performed at a molding temperature near the melting point of the cover. As used herein, the term "main body having a cover on which dimples have not been formed" means a solid core enclosed with a cover in the case of multipiece golf balls such as two-piece and three-piece golf balls, and a thread-wound core enclosed with a cover in the case of thread-wound golf balls.

A layer comprising a cover and a coating, whose material has contraction and expansion properties and a higher heat resistance than the material for the cover and which has a thickness of at least 15 μm, is compression-molded through the coating at a molding temperature near the melting point of the cover using molds whose inner walls are provided with projections for forming dimples. This enables dimple formation without forming burrs. That is, when compression molding is conducted through the cover at a molding temperature near the melting point of the cover, dimples are formed in the cover in a molten state. Since the coating has a higher heat resistance than the cover, the coating remains unmolten, so that the material for the coating does not flow into gaps between molds. Furthermore, since the coating is relatively thick, at least 15 μm, the molten cover material will not break the coating and flow into gaps between molds. Accordingly, it is less likely that burrs will be formed. Also, since the coating has contraction and expansion properties, it precisely follows dimple profiles, and so dimples are properly formed in the layer comprising the cover and the coating.

As described above, according to the present invention, dimple formation can be conducted after a coating is formed, thereby preventing reduced preciseness of dimple shape which would otherwise be caused by formation of the coating. Thus, the dimples obtained are precisely shaped and sharp edged, and thereby improve travel properties of a golf ball. Also, since no burrs are generated during dimple formation, reduced preciseness of dimple shape and variations in golf ball quality, which would otherwise be caused by deburring after dimple formation, can be prevented.

DESCRIPTION OF THE PREFERRED EMBODIMENTS

Figure 1:
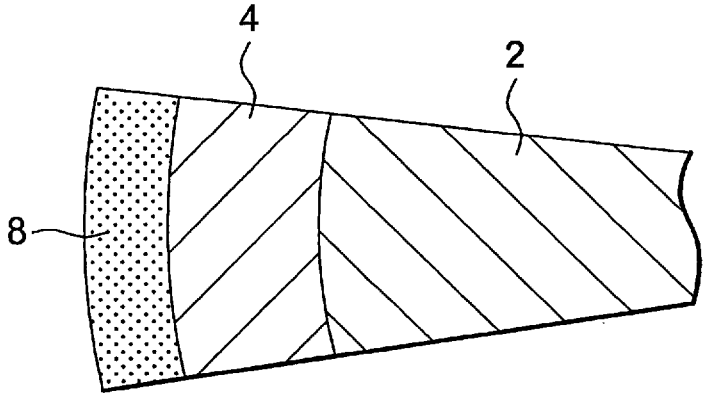
FIG. 1 is a partially enlarged sectional view showing a golf ball according to an embodiment of the present invention.

The present invention will next be described in more detail by reference first to FIG. 5. In the present invention, a layer comprising a cover 4 and a coating 6,8, whose material has contraction and expansion properties and a higher heat resistance than the material for the cover and which has a thickness of at least 15 μm, is provided at the surface portion of a golf ball.

The material for the cover is not particularly limited, but preferably, a thermoplastic resin is used as the material for the cover 4 in view of the fact that dimples are formed by compression molding after the cover is formed. Examples of such a thermoplastic resin include an ionomer resin and polyester. A resin as the material for the cover preferably has a softening point (Vicat softening point) of 80° to 150° C., particularly preferably 80° to 120° C., a melting point of at least 180° C., particularly preferably 180° to 250° C., and an MI (Melt Index) at 190° C. of 0.5 to 50, particularly preferably 1 to 10. Appropriately, the cover is of a single layer or a multilayer and has a thickness of approximately 1.0 to 2.0 mm.

The material for the coating must have a higher heat resistance than the material for the cover and contraction and expansion properties. Among various heat resistance indicators, at least a softening point and a melting point of the coating of the present invention are preferably higher than those of the cover. Specifically, a resin to form the coating preferably has a softening point of 80° to 150° C., particularly preferably 100° to 120° C., and a melting point of at least 200° C., particularly preferably at least 250° C. (no upper limit is specified because some thermosetting resins do not have a melting point). Within these ranges, the resin to form the coating has softening and melting points higher than those of the cover.

Among indicators of contraction and expansion properties, at least the elongation percentage (elongation at tensile test) and the Young's modulus (elastic modulus) are preferably high for the material for the coating of the present invention. Specifically, the resin to form the coating preferably has an elongation percentage of 200 to 900%, particularly preferably 400 to 800%, and a Young's modulus of 15 to 60 MPa, particularly preferably 20 to 30 MPa.

Figure 4:
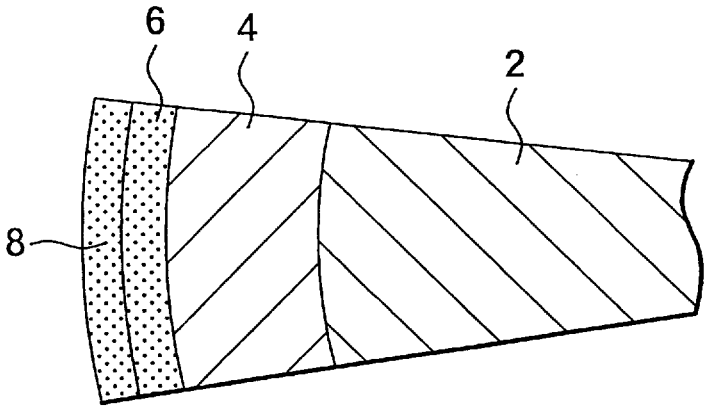
FIG. 4 is a partially enlarged sectional view showing a golf ball according to a further embodiment of the present invention.

The coating 6,8 is at least 15 μm thick. When the coating is thinner than 15 μm, the strength of the coating becomes too low. Consequently, when dimple formation is conducted through the coating by compression molding, there is a risk that a molten cover material breaks the coating and then flows into gaps between molds. The coating has more preferably a thickness of 15 to 500 μm, particularly preferably 30 to 200 μm. When the coating thickness exceeds 500 μm, the coating may fail to have stable quality due to cracking, the sag of a coating material, etc., resulting in deteriorated performance of a golf ball. When two layers of coating are formed (for example, as seen in FIG. 4), the thickness of each coating may fall within the above-described ranges.

In the present invention, when a coating is made relatively thick to a thickness of 30 to 700 μm to thereby increase the ratio of a coating volume to a golf ball volume, properties of the coating can influence performance of a golf ball such as travel properties, spin properties, and feel on impact. That is, by properly selecting properties of a coating, the coating can be given functions to improve travel properties, spin properties, and feel on impact of a golf ball.

The methods of forming a coating are not particularly limited, but any coating method may be employed. Preferred coating methods include, for example, a dipping method, a powder coating method, a dispersion coating method, and a hot melt coating method (application with a dispenser or spray gun). In the powder coating method, powder coating material, a kind of solventless powdery coating material is applied to an object surface, and subsequently, the applied coating material is fused by application of heat and is further cross-linked, thereby forming a coating. In the dispersion coating method, a resin powder, together with a suitable additive, is dispersed in water or an organic solvent, and the resulting emulsion is applied to an object surface by spraying or dipping, followed by drying and then heating at a predetermined temperature to thereby form a coating. In the hot melt coating method, a thermoplastic resin is discharged from, for example, a hot-melt dispenser in the form of a line, a spiral, spray, a sheet, or the like, and the thus-discharged thermoplastic resin is applied to an object surface.

In the present invention, the type of material for a coating is not particularly limited, but thermoplastic resin based coating materials or thermosetting resin based coating materials are preferred. Such coating materials include, for example, vinyl acetate resin based coating materials, acrylic resin based coating materials, epoxy resin based coating materials, urethane resin based coating materials, and polyester resin based coating materials. Among them, urethane resin based coating materials and acrylic resin based coating materials are particularly preferred in view of moldability and durability as a coating during dimple formation.

When a coating is formed of a thermosetting resin based coating material, the coating is easily deformed by application of heat and pressure, thereby obtaining an advantage that dimple formation by application of heat and pressure is facilitated when conducted after the coating is formed. When a coating is formed of a thermosetting resin based coating material, there is obtained an advantage that by application of heat and compression molding after the coating is formed, dimples are formed in a cover material through the coating, and at the same time, the coating can be set.

In golf balls of the present invention, a coating which is formed of a material having contraction and expansion properties and a higher heat resistance than the material for a cover and which has a thickness of at least 15 μm is applied to, for example, the following coatings, but is not limited thereto.

① In two-piece or three-piece golf balls and thread-wound golf balls, when a coating is applied onto a cover material surface, and then mark stamping is carried out, followed by application of an outermost layer coating of a golf ball, the coating on the cover material surface and/or the outermost layer coating is of the present invention.

② In two-piece or three-piece golf balls and thread-wound golf balls, when a mark is directly stamped onto the bare cover material surface, and then an outermost layer coating of a golf ball is formed, the outermost layer coating is of the present invention.

The present invention will be described in detail with reference to the drawings.

FIGS. 1 to 4 are partially enlarged views showing golf balls according to embodiments of the present invention.

Figure 5:
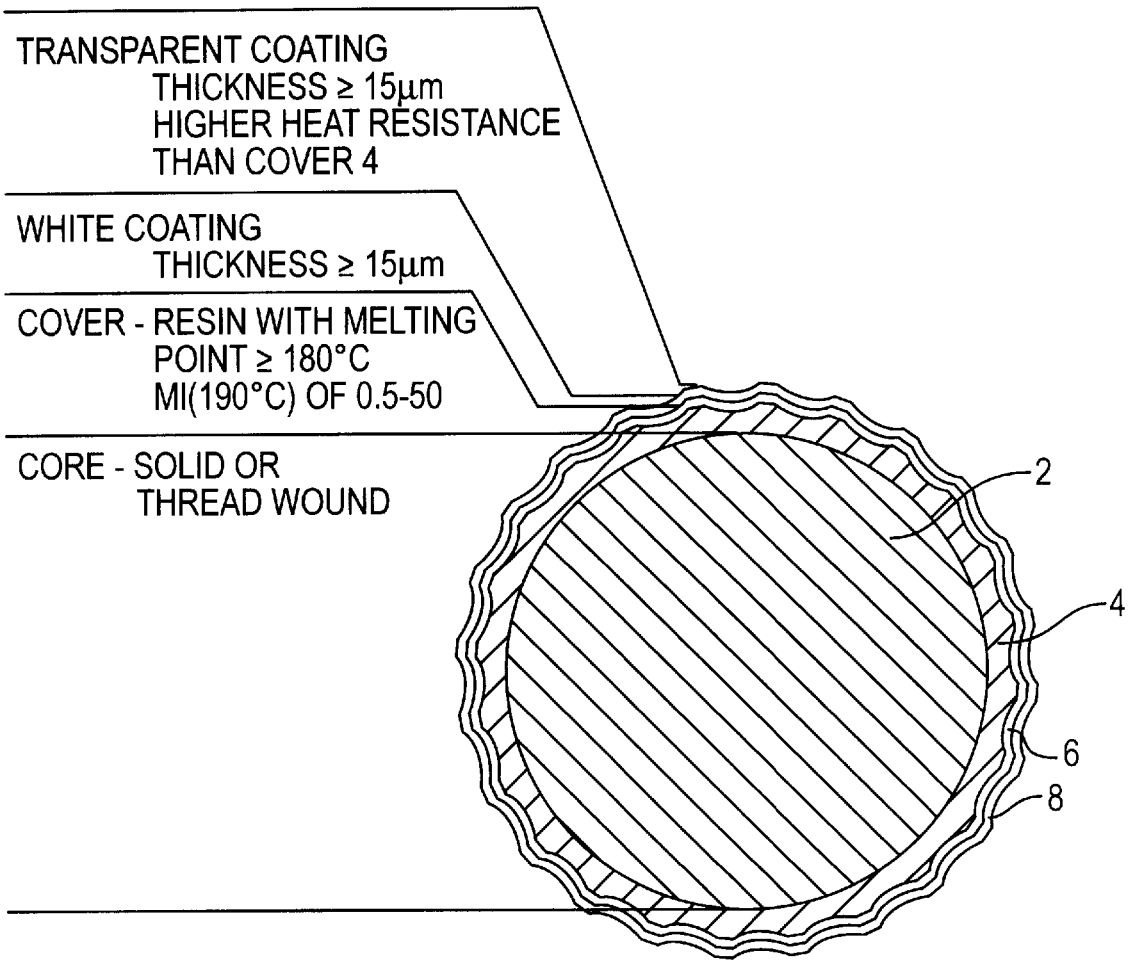
FIG. 5 is a cross-section of a golf ball in accordance with this invention.

FIG. 5 is a cross-section of a complete golf ball. These embodiments are of two-piece golf balls. Three-piece golf balls and thread-wound golf balls may be constructed in a manner similar to the two-piece golf balls of FIGS. 1 to 4. In addition, a mark to be formed by mark stamping and dimples are not shown in FIGS. 1 to 4.

The two-piece golf ball as shown in FIG. 1 is prepared by enclosing a solid core 2 with a cover 4; conducting mark stamping directly on the surface of the cover 4; forming, as an outermost layer of the ball, a transparent coating 8 having a thickness of at least 15 μm and made of a thermoplastic resin material having contraction and expansion properties and a higher heat resistance than the material for the cover 4; and finally conducting dimple formation.

Figure 2:
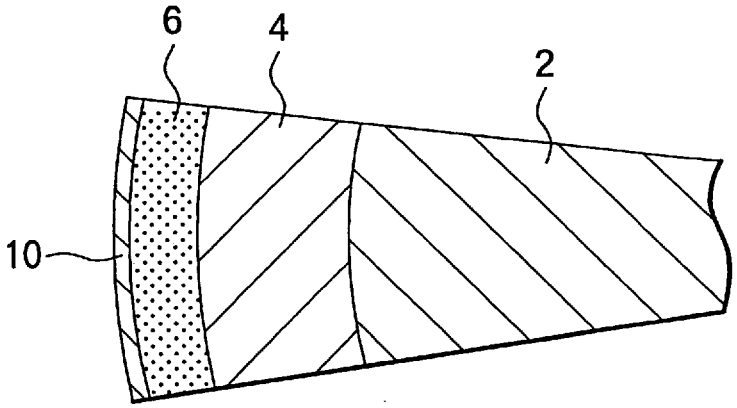
FIG. 2 is a partially enlarged sectional view showing a golf ball according to another embodiment of the present invention.

The two-piece golf ball as shown in FIG. 2 is prepared by enclosing a solid core 2 with a cover 4; forming a white coating 6 having a thickness of at least 15 μm and made of a thermoplastic resin material having contraction and expansion properties and a higher heat resistance than the material for the cover 4; conducting dimple formation through the coating 6; conducting mark stamping on the coating 6; and forming a clear, conventional coating 10 as an outermost layer of the ball.

Figure 3:
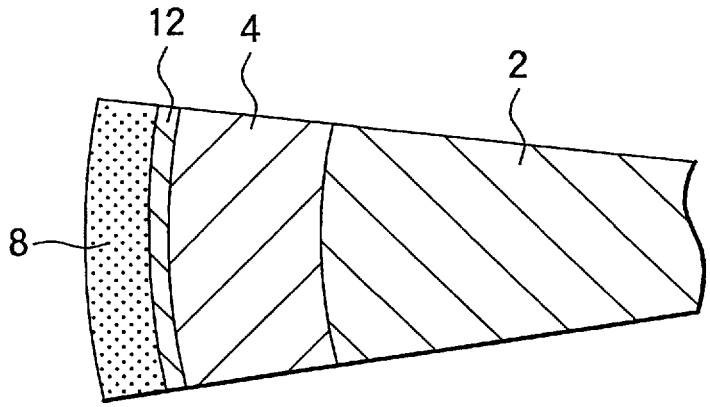
FIG. 3 is a partially enlarged sectional view showing a golf ball according to a further embodiment of the present invention.

The two-piece golf ball as shown in FIG. 3 is prepared by enclosing a solid core 2 with a cover 4; forming a conventional white coating 12 made of a two-pack system coating material on the surface of the cover 4; conducting mark stamping on the coating 12; forming, as an outermost layer of the ball, a transparent coating 8 having a thickness of at least 15 μm and made of a thermoplastic resin material having contraction and expansion properties and a higher heat resistance than the material for the cover 4; and finally conducting dimple formation. In the present embodiment, the conventional coating is interposed between the cover and the coating of the present invention. However, this structure can be considered such that the coating having a thickness of at least 15 μm and made of a material having contraction and expansion properties and a higher heat resistance than the material for the cover is substantially formed on the cover, and is therefore encompassed by the scope of the present invention.

The two-piece golf ball as shown in FIG. 4 is prepared by enclosing a solid core 2 with a cover 4; forming a white coating 6 having a thickness of at least 15 μm and made of a thermoplastic resin material having contraction and expansion properties and a higher heat resistance than the material for the cover 4; conducting mark stamping on the coating 6; forming, as an outermost layer of the ball, a transparent coating 8 having a thickness of at least 15 μm and made of a thermosetting resin material having contraction and expansion properties and a higher heat resistance than the material for the cover 4; and finally conducting dimple formation. In the two-piece golf ball of FIG. 4, the coating 6 may be formed of a thermosetting resin, whereas the coating 8 may be formed of a thermosetting resin, or the coatings 6 and 8 are both formed of a thermoplastic resin, or the coatings 6 and 8 are both formed of a thermosetting resin.

EXAMPLES

Two-piece golf balls as indicated in FIG. 1 were prepared in the above-mentioned procedure. In this case, a cover 4 having a thickness of 1.8 mm was formed of an ionomer resin (Himilan H1601 manufactured by DuPont-Mitsui Polychemical Co., Ltd.) by injection molding. A coating 8 having a thickness of 50 μm was formed of a urethane resin based coating material (Rezamin #2515 manufactured by Dainichi Seika Co., Ltd.) by spraying. Physical properties of the cover 4 and the coating 8 were as shown below.

Cover 4
- Softening point: 71° C.
- Melting point: 97° C.
- MI (190° C.): 1.2

Coating 8
- Softening point: 120° C.
- Melting point: 250° C. or higher
- Elongation percentage: 600%
- Young's modulus: 25 MPa In the above embodiments, precisely shaped, sharp-edged dimples were obtained, which were as precise and sharp as uncoated dimples obtained at the stage of a conventional production process where a core is enclosed with a cover material and is then subjected to dimple formation. Also, no burrs were generated during dimple formation.

What is claimed is:

1. A golf ball comprising a cover and a coating formed on the cover, in which dimples are formed in a layer composed of the cover and the coating, wherein the coating is formed of a material having contraction and expansion properties and a higher heat resistance than the material for the cover and has a thickness of at least 15 μm.

2. A golf ball according to claim 1, wherein the cover is formed of a resin having a softening point of 80° to 150° C., a melting point of at least 180° C., and an MI (190° C.) of 0.5 to 50.

3. A golf ball according to claim 1, wherein the coating is formed of a resin having a softening point of 80° to 150° C., a melting point of at least 200° C., an elongation percentage of 200 to 900%, and a Young's modulus of 15 to 60 MPa.

4. A golf ball according to claim 1, wherein the softening and melting points of the coating are higher than those of the cover.

5. A golf ball according to claim 1, wherein the structural characteristics of said dimples correspond to those of dimples which have been formed after the formation of the coating.

6. A golf ball according to claim 1, wherein the golf ball comprises a main body and one or more coating layers formed on the main body, at least one of the coating layers is formed of a material having contraction and expansion properties and a higher heat resistance than the material for the cover and has a thickness of at least 15 μm.

7. A golf ball according to claim 6, wherein the main body is a solid core enclosed with a cover, or a thread-wound core enclosed with a cover.

8. A golf ball according to claim 6 wherein said coating comprises a white coating formed on said cover and a transparent coating formed on said white coating.

9. A golf ball according to claim 8, wherein said transparent coating has a thickness of at least 15 μm and a higher heat resistance than the material for said cover.

10. A process for producing a golf ball comprising the steps of:

preparing a main body having a cover on which dimples have not been formed;

forming on the surface of the main body a coating which is formed of a material having contraction and expansion properties and a higher heat resistance than the material for the cover and which has a thickness of at least 15 μm; and forming dimples through the coating by conducting compression molding at a molding temperature near the melting point of the cover.

11. A process for producing a golf ball according to claim 10, wherein the cover is formed by using a resin having a softening point of 80° to 150° C., a melting point of at least 180° C., and an MI (190° C.) of 0.5 to 50.

12. A process for producing a golf ball according to claim 10, wherein the coating is formed by using a resin having a softening point of 80° to 150° C., a melting point of at least 200° C., an elongation percentage of 200 to 900%, and a Young's modulus of 15 to 60 MPa.

13. A process for producing a golf ball according to claim 10, wherein the softening and melting points of the coating are set to be higher than those of the cover.

14. A process for producing a golf ball according to claim 10, wherein the main body is a solid core enclosed with a cover, or a thread-wound core enclosed with a cover.

* * * * *